US007229368B1

(12) United States Patent
Fertig

(10) Patent No.: US 7,229,368 B1
(45) Date of Patent: Jun. 12, 2007

(54) HOCKEY GOAL

(76) Inventor: Grayson M. Fertig, 154 Bowers Hill Rd., Oxford, CT (US) 06478

( * ) Notice: Subject to any disclaimer, the term of this patent is extended or adjusted under 35 U.S.C. 154(b) by 110 days.

(21) Appl. No.: 10/916,903

(22) Filed: Aug. 12, 2004

Related U.S. Application Data

(60) Provisional application No. 60/494,415, filed on Aug. 13, 2003.

(51) Int. Cl.
*A63B 63/00* (2006.01)

(52) U.S. Cl. ..... 473/478; 473/446; 273/400

(58) Field of Classification Search ..... 473/478, 473/454, 197, 422; 273/396, 400
See application file for complete search history.

(56) References Cited

U.S. PATENT DOCUMENTS 5,476,266 A * 12/1995 Caruso ..... 473/478
6,113,507 A * 9/2000 Padilla ..... 473/478
2002/0115508 A1* 8/2002 Bourdages ..... 473/476

OTHER PUBLICATIONS

SoccerConnections Webpage, 2002, www.soccerconnections.net, 18 pages.*

* cited by examiner

*Primary Examiner*—Stephen Blau
*Assistant Examiner*—M. Chambers
(74) *Attorney, Agent, or Firm*—Alix, Yale & Ristas, LLP

(57) ABSTRACT

The goal posts of the ice hockey goal are colored gray instead of the current color red. The goal net is colored red instead of the current color white. The nylon cord of the goal netting is knotted in such a way as to form triangles instead of the current diamonds/squares.

7 Claims, 2 Drawing Sheets

HOCKEY GOAL

CROSS-REFERENCE TO RELATED APPLICATION

This application claims the priority of U.S. Provisional Application No. 60/494,415 filed on Aug. 13, 2003.

BACKGROUND OF THE INVENTION

This invention relates generally to goals used in the sport of ice hockey.

Rule 3c and 3d in the Official Rules of the NHL state the criterion for the currently used ice hockey goal in regards to color:

(3c) there shall be attached to each goal frame a net of approved design made of white nylon cord which shall be draped in such a manner as to prevent the puck coming to rest on the outside of it . . . .

(3d) the goal posts and cross-bar shall be painted in red and all other exterior surfaces shall be painted in white, (www.nhl.com).

Rule 3 also sets forth the requirements for the net in pertinent part as follows:

The frame of the goal shall be draped with a nylon mesh net so as to completely enclose the back of the frame. The net shall be made of three-ply twisted twine (0.130 inch diameter) or equivalent braided twine of multifilament white nylon with an appropriate tensile strength of 700 pounds. The size of the mesh shall be two and one-half inches (2½") (inside measurement) from each knot to each diagonal knot when fully stretched. Knotting shall be made as to ensure no sliding of the twine. The net shall be laced to the frame with medium white nylon cord no smaller in size than No. 21.

The current color system is red posts with white netting and it is this very system that leaves hockey player, when shooting the puck, shooters at a decided perceptual disadvantage when as they visually process the target.

The hockey goal itself, with color set aside for a moment, is an enormous perceptual challenge. This is because a goal is scored when the puck crosses the goal line. Yet, when a shooter must make his judgments about the goal, he is basing his estimates on shooting the puck to the back of the goal and not, as would be the most accurate, on shooting the puck so that it breaks the plane of the goal line. The netting is at some points nearly four feet behind the goal line. The unfeasibility of imaging that plane rather than seeing the back of the net makes this a formidable obstacle in the act of shooting. The great basketball player and thinker Jerry Lucas overcame the issue of breaking a plane in order to score in his sport by imagining the face of a clock overlaying the opening of the hoop. In doing so Lucas refined one of the most consistent outside shots ever seen, but the variances in appearance of a goal caused by goaltender positioning would make this concept difficult to apply to hockey.

This issue of seeing the plane is complicated further by two components of the current goal. The first is that the red goal posts will always perceptually appear nearer than they really are. The other is that the light colored netting, currently white, increases one's sense of volume. As described by Mahnke and Mahnke, "Lightness is one of the most important factors in the perception of openness in the interior space. Light or pale colors recede and increase the apparent room size," (Mahnke, Frank H. and Rudolf H. Mahnke. *Color and light in man-made environments*. New York: Van Nostrand Reinhold, 1987, 16). Thus white causes the actual volume and depth of the space between the plane of the goal line and the actual netting [erase: of an ice hockey goal] to appear as even greater than it really is. A solution to this, as proposed by the inventive hockey goal herein involves the employment of a red net. This will have some degree of impact on shrinking the perceived space between the goal line and the net. "Dark or saturated hues protrude and decrease the apparent size of a room," (Mahnke, Frank H. and Rudolf H. Mahnke. *Color and light in man-made environments*. New York: Van Nostrand Reinhold, 1987, 16). This will cause the hockey shooter to see the back of the net as closer to the plane of the goal line, which will make for more accurate mental estimations of the trajectory needed for a puck that will leave the player's stick and break that given plane.

There are four major factors that have led to the documented goal scoring depression in organized hockey. The factors are: 1. the ongoing evolution of goaltending in both technique and equipment; 2. improvement of defense on both an individual level and in the area of team defense; 3. the continued and possibly heightened use of the illegal defensive strategies obstruction/holding; and 4. the adaptive nature to professional players by youth players who tend to develop their games so as to best suit the present demands of the NHL game. These areas of the game have combined to make goal scoring more difficult than ever before, which guarantees lower levels of scoring and higher costs of trying to score. The applicant has analyzed the issue of diminished scoring and has discovered that the sport has been using a goal that does not optimize the shooter's ability to see the target-especially during high speed chaotic game conditions. If scoring truly is a primary concern, then the target defined by the goal must be enhanced to be more shooter-friendly.

Despite significant attention being paid to the NHL's serious downturn in offensive production the issue remains unresolved due to the constraints of hockey tradition and the desire to promote basic hockey skills. The changes provided in the inventive hockey goal are moderately progressive and they do not disrupt hockey tradition. Because the invention enhances the visibility of the goal/target, there will be an impact that is felt on every shot taken, which is a claim that other proposed solutions such as removing the "redline", cannot make. It is the ability of the inventive hockey goal herein to be a factor in every shot taken that makes the invention a viable tactical response to this that has been called "The Dead Puck Era".

SUMMARY OF THE INVENTION

Briefly stated, the invention in a preferred form is a hockey goal which provides enhanced visibility during on-ice and game conditions. The hockey goal in one preferred embodiment employs a net attached to the goal frame which is red as viewed from a front location as opposed to the current color of white. The netting ties form the shape of triangles as opposed to the current shapes of diamonds/squares. The metal goal posts are gray rather than the current color of red. The physical shape and purpose of the ice hockey goal remains otherwise unchanged.

In one embodiment of the invention, a two layer net is suspended from the frame. The layer viewed from in front of the goal is red. The layer viewed from the side and back of the goal is white.

An object of the present invention is to enhance the visibility of the hockey goal to thereby enhance the opportunity to score a goal.

Another object of the present invention is to provide a new and improved goal which exhibits improved visibility characteristics during game conditions and does not significantly depart from the traditional hockey rules, conditions and performance standards.

DETAILED DESCRIPTION OF THE INVENTION

Figure 1:
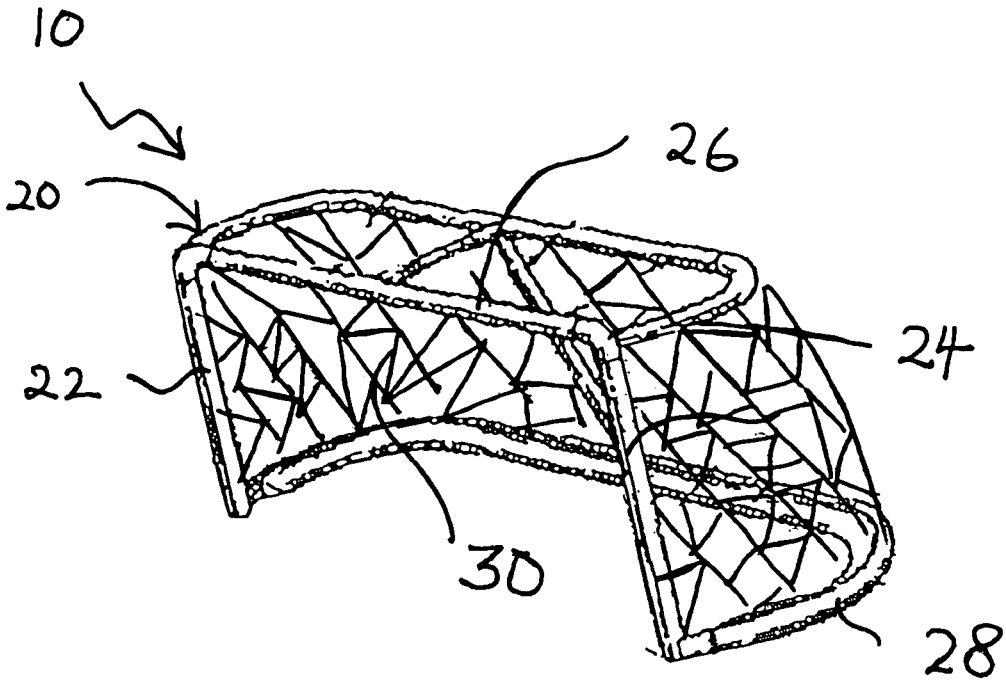
FIG. 1 is a perspective view of a hockey goal incorporating the present invention.

With reference to the drawing, wherein like numerals represent like parts throughout the figures, a hockey goal in accordance with the invention is generally designated by the numeral 10. The hockey goal is configured to provide enhanced visibility during game conditions.

The goal 10 includes a tubular metal frame 20 including a pair of upright goal posts 22, 24 and a cross-bar 26 which cooperate to define a rectangular front opening 12. A tubular support base 28 extends rearwardly from the uprights. A net 30 is secured to the frame 20 along the base, uprights and cross-bar in a conventional fashion. The dimensions of the goal, the frame and the net are conventional.

In accordance with the invention, the net 30 has an outer surface which, when viewed from a location in front of the net, is substantially red. In one embodiment, the net 30 is entirely red at its exterior. Alternatively, the net may be red on one side and white on the other side. The metal goal posts 22, 24 and preferably the cross-bar 26 have a substantially matte gray outer surface. The gray surface may be achieved by a suitable paint.

Figure 2:
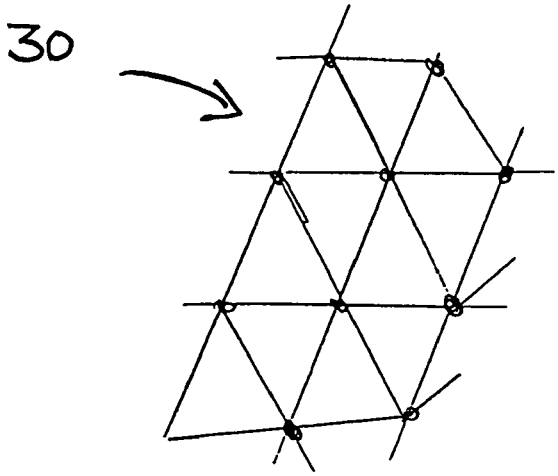
FIG. 2 is an enlarged fragmentary view of the net of the hockey goal of FIG. 1.

With reference to FIG. 2, the goal net 30 comprises nylon cord which is preferably knotted to form a continuous pattern of a substantially congruent triangular shaped mesh configuration.

Figure 3:
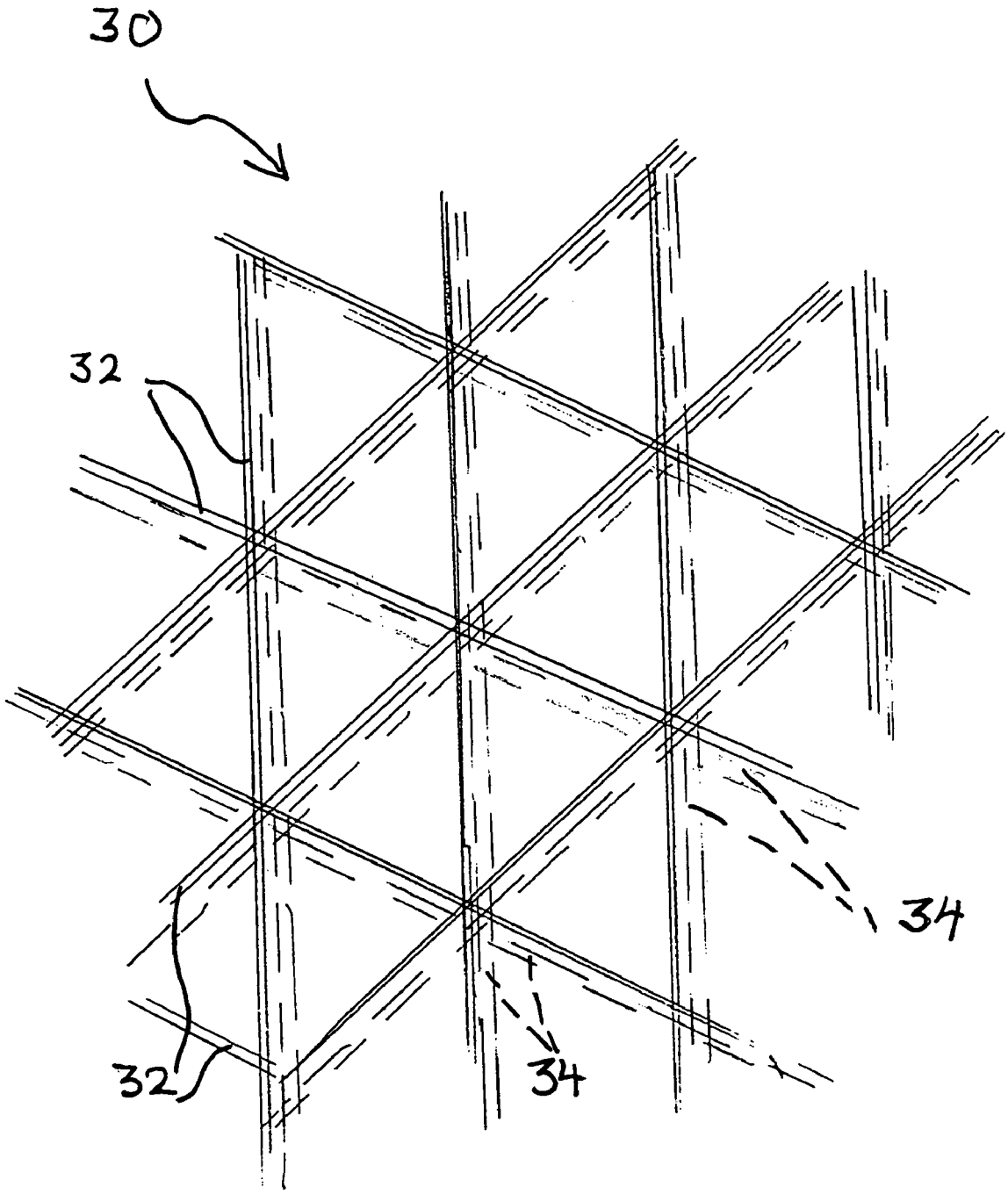
FIG. 3 is an enlarged fragmentary view, partly in phantom, of a two layer net which may be employed in the hockey goal of FIG. 1.

With reference to FIG. 3, the net 30 may comprise two layers 32 and 34 disposed in back-to-back relationship. Layer 32 which is positioned at the inside of the goal enclosure is red and is visible from a location in front of the goal opening. Layer 34 which is white is positioned at the outside of the goal enclosure and is visible from the location at the sides and rear of the goal.

It should be appreciated that the hockey goal 10 employs gray metal goalposts 22, 24 rather than the current color of red. The cross-bar 26 is also preferably gray. The net 30 is red as opposed to the conventional white color. The net has a triangular-shaped mesh configuration in contrast to the conventional shape of a diamond/square. All of the foregoing features cooperate to enhance the visibility of the central portions of the goal and make the goal more discernible to players who are typically moving at high speeds and must react extemporaneously and instinctively to launch a shot toward the goal.

The conventional color of the current goal posts is red as detailed by NHL Rule 3d. Because of the way the eye's retina focuses red and the mind's subsequent interpretation of that information, it is impossible for the player to successfully locate the target/net with a high degree of consistency. The hockey goal 10 reworks the color system of the goal in order to enhance the visibility of the actual target.

It should be noted that orange and yellow also have exceptionally strong visual characteristics when compared to other colors, but they lack in certain areas that red excels such as proven human responsiveness and volume perception. However, to introduce a garish color such as yellow or orange would not easily fit into the landscape of the rink as pertaining to the goal when red is not only the ideal color choice, but it already is an integral part of the ice rink. Gray is not prominent at the conventional rink, but it is generally a non-intrusive color while retaining a degree of formality and or understated boldness.

The reasons for replacing the traditional white net with red are based on both the properties of red, that have already been discussed, but also on the properties or inadequacies of white as the target color. Not only is white not the dominant color that red is, but its ability to arouse the viewer is much less than red as well. "In psychological color-preference tests, this (white) bleak and emotionless hue is at the bottom of the list. It has been noted that reaction to white is one of bored disinterest," (Mahnke, Frank H. and Rudolf H. Mahnke. *Color and light in man-made environments*. New York: Van Nostrand Reinhold, c1987, 23).

White, as any hockey observer knows, is the dominant color of a rink: white boards, white ice, white uniforms, white goalie pads, etc. All of this works against the ability of the shooter's eye to attach its focus to the white netting, which is ultimately a large part of what is needed in the execution of a successful shot. Shimon Ullman speaks to this in his essay "Visual Routines"; the phrase he uses for the eye's identification of an object in a scene is indexing, "a location can be indexed if it is sufficiently different from its surrounding in an indexable property. Indexable properties, which are computed in parallel by the early visual processes, included contrast, orientation, color, motion, and perhaps also size, binocular disparity, curvature, and the existence of terminators, corners, and intersections," (Pinker, Stephen ed. *Visual cognition*. Cambridge, Mass.: MIT Press, 1985, 155). White is not "sufficiently different" than the boards behind the net or the white of the five-whole, but the red of the current goal posts is. Therefore the eye, which already cannot help but be overwhelmed by red, is flooded further with the color of the posts because it is "sufficiently different."

Goal posts painted gray will not only not dominate and not come forward, as they do in their current form as red, but they will also be less luminous or less shiny, "A high illumination level will enlarge the appearance of volume, whereas a low illumination level will diminish it," (Mahnke, Frank H. and Rudolf H. Mahnke. *Color and light in man-made environments*. New York: Van Nostrand Reinhold, 1987, 16). This is a very important adjustment considering the seeming largeness of volume belonging to red luminous goal posts that deludes the shooter into perceiving less net volume in the areas just around posts, which are the places where the puck needs to go, especially in today's game in which goaltenders are shrinking the net by being larger and more skilled than ever before. In addition to this, the less-luminous gray posts will not capture the shooters attention in situations such as a "one-timer" or any other split-second shot where the shooter only momentarily focuses the target thus allowing him in those "quick-release" situations to focus only the target red net.

The luminosity or shininess a player sees is caused by a combination of the free electron properties of metal and by an applied gloss red paint that encourages that brilliance.

While this may look sharp to an observer it stands as a distraction in any "quick-release" situation when the player in his limited time window will only have enough time to focus the part of the scene with the highest reflectance value which he cannot help but see first. Television lights and strong arena lighting enhance this shine because they come from all angles at a cylindrical object/the post, thus creating infinite angles of reflection. Often times in "one-timer" situations or the like the player is relying on his peripheral vision to locate the net and peripheral vision relies on the photo-receptor cells in the retina called rods which are sensitive to brightness and therefore a players peripheral vision will locate the currently high gloss red posts and see very little if any of the white net. The gray of the hockey goal 10 will serve to dull the reflection and as gray is naturally seen after red in color recognition sequences it will allow the red net to be the brightest color in the scene when a player is using his peripheral vision and thus the first and foremost color focused by the player in the "quick release" situations that given an accurate shot so often result in goals.

The final feature of the hockey goal 10 is the weaving of the net so that it forms the shape of triangles and not the conventional shape of squares. The net openings are not drastically changed and the material and size of the cord will be unchanged. The reason for this change is that the squares when stretched over the goal frame become diamonds that hold a less consistent symmetrical shape, appearing in places almost circular. A triangle's three points, as opposed to a square's four, will enable the shape to remain almost unchanged when stretched. In his more than fifty years of research Faber Birren has found that, "Triangles and squares (or pyramids and cubes), incidentally, are easier to perceive and orient in space than is a circle or sphere. This may be because the sphere lacks sharpness and is not easy for the eye to focus on." He states further that, "The eye forever seeks symmetrical forms and concentrates on them," (Birren, Faber. *Color, form, and space*. New York, Reinhold Pub. Corp., 1961, 18). Even if the difference in effectiveness of the shapes formed by netting is only minor it will to some degree positively impact the shooter's ability to locate and fix his focus upon the target.

While the foregoing description of the invention has been set forth for purposes of illustration, the description herein should not be deemed a limitation of the invention. Accordingly, various modifications, adaptations and alternatives may occur to one skilled in the art without departing from the spirit and scope of the present invention.

What is claimed is:

1. A goal for ice hockey comprising:

a frame including a base and a pair of upright goal posts and a cross-bar extending between upper portions of the goal posts to form a substantially rectangular frontal opening; and a ice hockey net attached to the frame and having a substantially red surface as viewed from a location in front of the frontal opening and exhibiting generally a white color as viewed from a rear and a side location;

wherein said net comprises two layers a inner layer being red and an outer layer not being red.

2. The goal of claim 1, wherein said uprights have an outer surface having a gray color.

3. The goal of claim 1, wherein said uprights and said cross-bar have an outer surface having a gray color.

4. The goal of claim 1, wherein said net comprises two layers, one of said layers being red and the other said layer being white.

5. A goal for ice hockey comprising:

a frame including a base and a pair of upright goal posts and a cross-bar extending between upper portions of the goal posts to form a substantially rectangular frontal opening, said goal posts having a gray exterior surface; and a ice hockey net attached to the frame wherein said net comprises two layers a inner layer being red and an outer layer not being red and wherein said net has a substantially red surface as viewed from a location in front of the frontal opening, said net having a generally triangular-shaped mesh pattern.

6. The goal of claim 5, wherein said net comprises two layers, one of said layers being red and the other said layer being white.

7. The goal of claim 5, wherein said net, as viewed from a rear and a side location, exhibits generally a white color.

* * * * *